US005089678A

United States Patent [19]

Zemp et al.

[11] Patent Number: 5,089,678

[45] Date of Patent: Feb. 18, 1992

[54] MECHANICAL MOMENTARY OR ALTERNATE ACTION SWITCH

[75] Inventors: Othmar Zemp, Sursee; Albrecht Meier, Gerlafingen, both of Switzerland

[73] Assignee: Elektro-Apparatebau Olten AG, Olten, Switzerland

[21] Appl. No.: 559,664

[22] Filed: Jul. 30, 1990

[30] Foreign Application Priority Data

Jul. 28, 1989 [CH] Switzerland ..... 2820/89

[51] Int. Cl.[5] ..... H01H 5/06

[52] U.S. Cl. ..... 200/454; 200/458; 200/526; 200/314

[58] Field of Search ..... 200/526, 454, 457, 458, 200/465, 466, 314

[56] References Cited

U.S. PATENT DOCUMENTS

| | | | |
|---|---|---|---|
| 2,755,353 | 7/1956 | Bachi | 200/457 |
| 3,430,012 | 2/1969 | Langenberger et al. | 200/465 |
| 4,398,075 | 8/1983 | Vogel | 200/314 |
| 4,933,523 | 6/1990 | Honda et al. | 200/526 |

FOREIGN PATENT DOCUMENTS 650618 7/1985 Switzerland .

*Primary Examiner*—Renee S. Luebke
*Attorney, Agent, or Firm*—Peter K. Kontler

[57] ABSTRACT

A switch wherein an elongated at least substantially tubular housing contains a bearing member pivotably mounting a two-armed lever. One arm of the lever is directly coupled to a motion transmitting device which is rigid with a depressible pushbutton and carries a reflector for a light source behind the pushbutton. The other arm of the lever can move the front end of a stressed leaf spring which bears against a pivotable contact to urge the latter against an electric terminal in depressed position of the pushbutton or against an insulating stop in extended position of the pushbutton. A coil spring reacts against the bearing member and biases the lever to an end position in which the contact engages the stop; the lever then maintains the pushbutton in the extended position. If the switch is to be used as an alternate action switch, the bearing member carries an indexible blocking device cooperating with an indexing device which is reciprocable by the pushbutton to ensure that a first depression of the pushbutton results in retention of the contact in engagement with the terminal (switch closed) and that the next-following depression of the pushbutton enables the coil spring to pivot the lever so that the contact can be moved against the stop to thus open the switch.

14 Claims, 4 Drawing Sheets

MECHANICAL MOMENTARY OR ALTERNATE ACTION SWITCH

CROSS-REFERENCE TO RELATED CASE

The switch of the present invention is identical with the switch which is disclosed in the commonly owned copending patent application Ser. No. 07/559,663 filed Jul. 30, 1990 for "Mechanical momentary or alternate action switch".

BACKGROUND OF THE INVENTION

The invention relates to improvements in mechanical momentary or alternate action switches. More particularly, the invention relates to improvements in mechanical switches of the type wherein a stressed spring in the switch housing serves to move a contact between first and second positions in one of which the switch is open and in the other of which the switch is closed.

Swiss Pat. No. 650 618 (U.S. Pat. No. 4,398,075) discloses a mechanical switch wherein the stressed spring is mounted for movement in a direction substantially at right angles to a plane halving the angles of pivotability of the contact between its first and second positions. The stressed spring is movable in the plane of pivotability of the contact between its two positions. One end of the stressed spring bears against the contact, and the other end of the stressed spring reacts against a lever. One arm of the lever is pivotably mounted in the housing immediately adjacent a first wall of the housing and another arm of the lever extends substantially diametrically of and across the interior of the housing to a second wall which is located opposite the first wall. The pivot axis for the contact is located between the pivot axis for the lever and the central longitudinal axis of the housing. The switch further comprises an actuator which can pivot the second arm of the lever through the medium of a compensating spring which can be said to constitute a step-down transmission between the actuator and the lever. The actuator can be depressed to thereby stress the compensating spring which pivots the lever against the opposition of a restoring or return spring Since the locus of engagement between the lever and the stressed spring is remote from the pivot axis for the contact, the patented switch exhibits a pronounced switching hysteresis. Moreover, and since the restoring spring opposes the aforementioned compensating spring, the exact distance which the actuator must cover in order to change the position of the contact cannot be determined with a desired degree of accuracy. Still further, the patented switch is relatively long and bulky because the free end of the pivotable contact must be located at a considerable distance (as seen in the axial direction of the housing) from the locus where the stressed spring reacts against the lever.

OBJECTS OF THE INVENTION

An object of the invention is to provide a mechanical switch which is more compact than heretofore known mechanical switches of the above outlined character.

Another object of the invention is to provide a mechanical switch wherein a movement of a pushbutton or an analogous part through a preselected distance invariably ensures a change from switch-open to switch-closed position or in the opposite direction.

A further object of the invention is to provide a novel and improved combination of parts which transmit motion from a depressible actuator to a contact which must be moved (e.g., pivoted) in order to open or close the switch.

An additional object of the invention is to provide the above outlined switch with novel and improved means for blocking or arresting the contact in a selected position between successive depressions of a pushbutton or an analogous actuator.

Still another object of the invention is to provide a relatively short and slender housing for use in the above outlined mechanical switch.

A further object of the invention is to provide a novel and improved connection between the actuator and the lever for the stressed spring in the above outlined mechanical switch.

SUMMARY OF THE INVENTION

The invention is embodied in a mechanical switch which comprises a housing, a bearing member in the housing, a contact which is disposed in the housing and is movable between first and second positions in which the switch is respectively open and closed, and means for moving the contact between its first and second positions. The moving means includes a retainer, means for movably mounting the retainer on the bearing member, a stresses spring having a first portion reacting against the retainer and a second portion bearing against the contact, and actuator means for moving the retainer relative to the bearing member to thereby move the contact through the medium of the spring.

The contact is preferably resilient and is preferably pivotable between its first and second positions in a predetermined plane and through a predetermined angle which is halved by a second plane. The arrangement is preferably such that the retainer is movable relative to the bearing member substantially transversely of the second plane and the bearing member is preferably affixed to and rigid with the housing.

The retainer preferably includes a lever and the mounting means preferably defines for the lever a pivot axis. The lever includes an arm having a portion which is engaged by the first portion of the spring and is located at a predetermined distance from the pivot axis. The contact is preferably pivotable relative to the housing about a second axis which is located at or close to the aforementioned predetermined distance from the pivot axis for the lever. The stressed spring biases the lever in a first direction, and the switch preferably further comprises a second spring which operates between the bearing member and the lever to bias the lever in a second direction counter to the first direction. The lever is pivotable between two end positions and the second spring serves to bias the lever to one of the two end positions. The actuator means is operable to move the lever to the other end position against the resistance of the second spring.

The lever can constitute a bell crank lever further having a second arm which is engaged by the second spring. The housing can include an elongated tube, and the second arm of the lever is pivotable through an angle having two halves at opposite sides of a plane which is substantially normal to the axis of the tube. The plane which halves the aforementioned predetermined angle is or can be substantially parallel to the axis of the tube.

The actuator means can comprise a pushbutton which is movable in the axial direction of the tube, means for transmitting motion from the pushbutton to the second arm of the lever, and means for articulately connecting the motion transmitting means with the second arm of the lever so that a translatory movement of the pushbutton is converted into pivotal movement of the lever and a pivotal movement of the lever (under the action of the second spring) is converted into a translatory movement of the motion transmitting means. The motion transmitting means can be rigid with the pushbutton, and the connection means can include means for directly coupling the motion transmitting means to the second arm of the lever.

The actuator means can further comprise or carry a reflector which is or can be rigid with the pushbutton. The motion transmitting means can be designed to receive motion from the reflector. Such motion transmitting means can comprise two resilient prongs, and the aforementioned connecting means can be designed to articulately connect the prongs to the second arm of the lever. Such connecting means can comprise complementary first and second detents provided on the prongs and on the second arm, respectively.

If the switch is to be operated as a so-called latching or alternate action switch, it further comprises an indexible blocking device which is mounted on the bearing member, and the actuator means then comprises or carries an indexing device for the blocking device. The indexing device is reciprocable between first and second positions and the two devices have cooperating retaining portions which prevent a return movement of the indexing device from first position to second position (particularly all the way to second position) in response to a first movement of the indexing device to its first position but permit a return movement of the indexing device all the way to its second position in response to a second movement of the indexing device to its first position. The indexing device moves from its second to its first position in response to depression of the pushbutton. The aforementioned second spring serves to yieldably bias the indexing device to its second position. If desired, the motion transmitting means can serve as a carrier of the indexing device, i.e., such motion transmitting means can transmit motion from the pushbutton to the indexing device. Alternatively, the indexing device can receive motion directly from the pushbutton.

The indexing device can be provided with a chamber for the blocking device and with an inlet which serves to admit the blocking device into the chamber in response to initial movement of the indexing device to its first position. The indexing and blocking devices are preferably provided with means for locating the blocking device in a predetermined angular position in response to initial movement of the indexing device to its first position. The locating means of the indexing device can be provided at the inlet to the chamber.

The switch preferably further comprises a light source (e.g., a light emitting diode) which is installed in the housing and has first electric contacts separably engaging complementary second electric contacts in the housing. Such switch can further comprise means for engaging and disengaging the first contacts (of the light source) from the complementary second contacts, and such engaging/disengaging means can include the aforementioned reflector which is connected with the motion transmitting means. The second contacts can extend into sockets for the contacts of the light source. The pushbutton of the actuator means preferably overlies the light source.

The novel features which are considered as characteristic of the invention are set forth in particular in the appended claims. The improved mechanical switch itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 2:
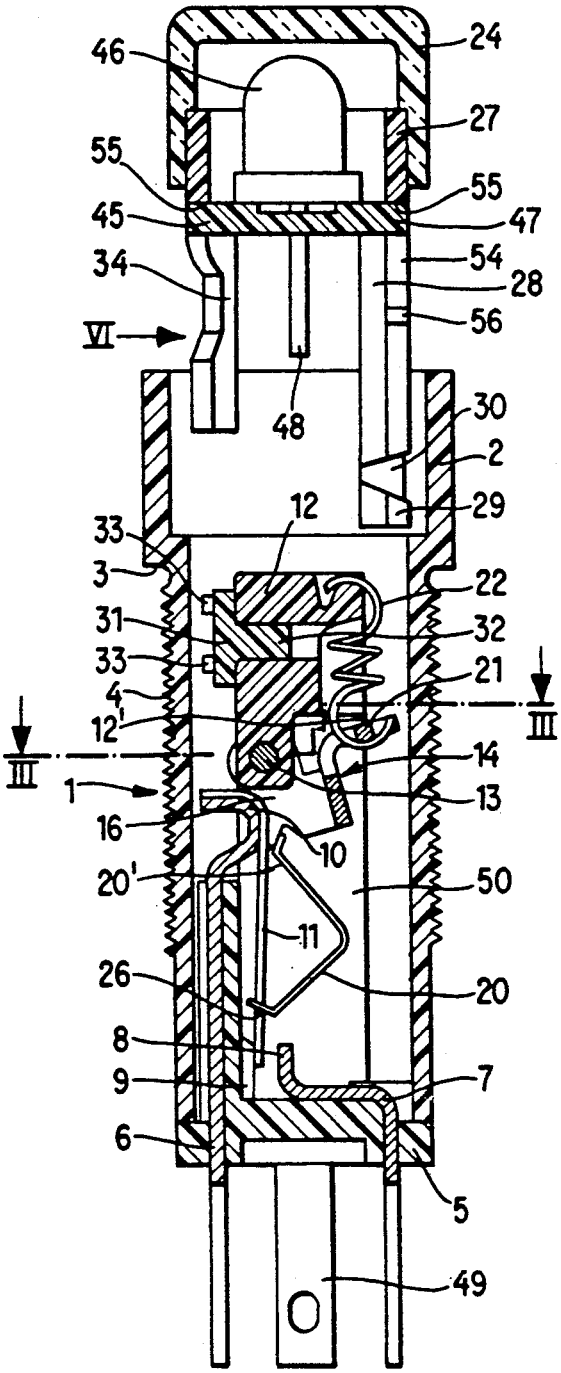
FIG. 2 illustrates the structure of FIG. 1 but with the pushbutton, radiation source and reflector detached from the housing.

The mechanical switch which is shown in FIGS. 1 to 5 comprises a housing 1 the major part of which is an elongated tube in the form of a slender cylinder having external threads 4. The front portion 2 of the housing 1 constitutes a frame having an external shoulder 3 adjacent the front end of the threaded tube. The threads 4 of the tube can mate with the internal threads of a nut (not shown) which can be used to urge the shoulder 3 against the front side of a mounting plate, not shown, so that the frame 2 is accessible together with a pushbutton 24 which can be depressed in order to open or close the switch.

Figure 1:
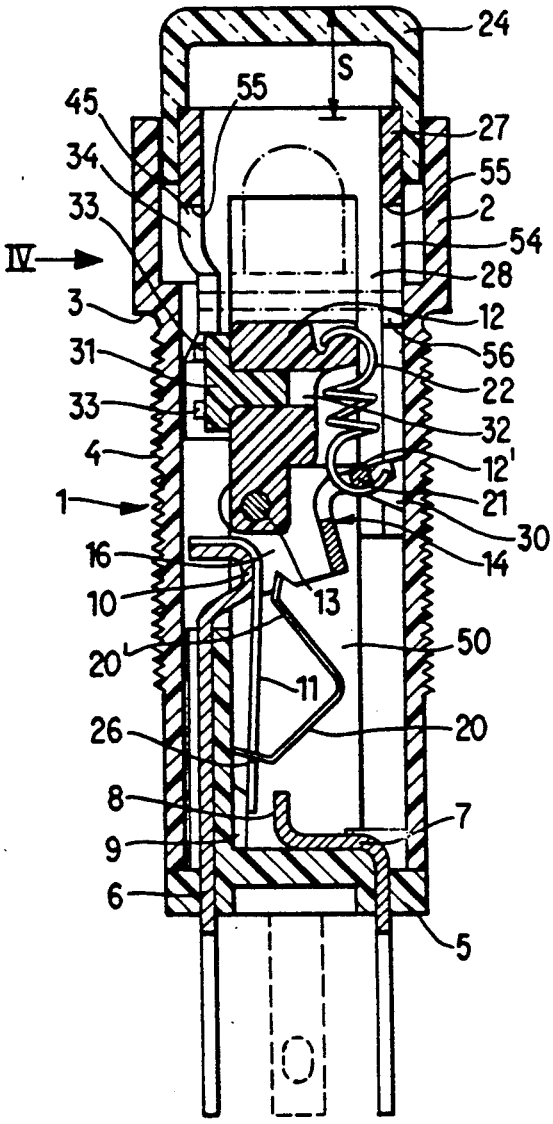
FIG. 1 is a central longitudinal sectional view of a mechanical switch which embodies one form of the invention.

The rear end of the externally threaded tube of the housing 1 is connected with an end wall or base 5 which is traversed by two electrically conductive terminals 6 and 7. The substantially Z-shaped terminal 7 includes a tip 8 which is located in the interior of the housing 1 and is spaced apart from a fixed insulating stop 9 which is inwardly adjacent an elongated straight portion of the terminal 6. That end portion (10) of the terminal 6 which is located in the housing 1 forms a relatively large loop which serves as a fulcrum for the substantially L-shaped front end portion of a resilient contact 11. The end portion 10 of the terminal 6 defines for the contact 11 a pivot axis which is normal to and is somewhat offset from the central longitudinal axis X (FIG. 5) of the externally threaded tube of the housing 1. The rear end portion of the contact 11 is exposed and moves between the fixed stop 9 and the tip 8 of the terminal 7. The switch is open when the contact 11 is maintained in the position which is shown in FIGS. 1 and 2, namely when the rear end portion of the contact 11 abuts the insulating stop 9. In order to close the switch, i.e., to establish an electrical connection between the terminals 6 and 7, the rear end of the contact 11 must be moved to a second position in which it engages the tip 8 of the contact 7.

Figure 5:
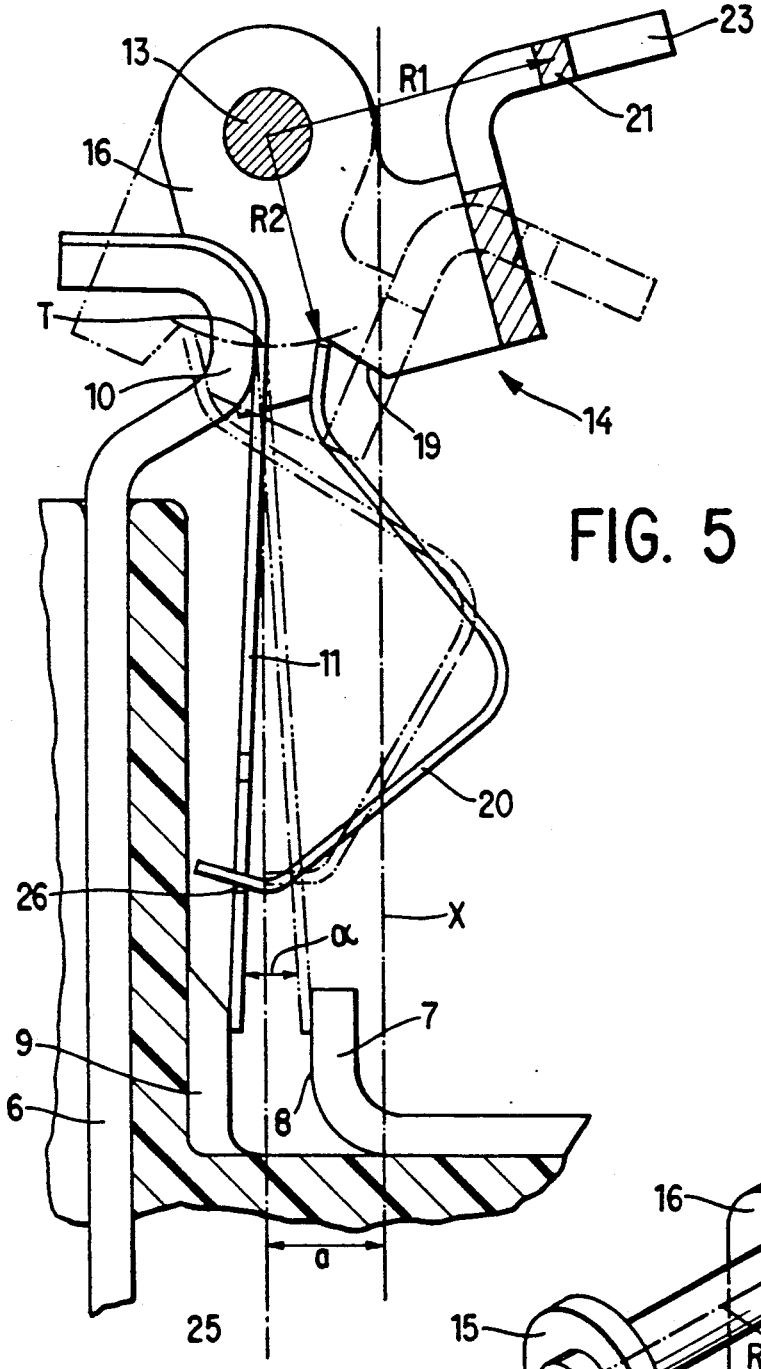
FIG. 5 is an enlarged view of another detail in the switch of FIG. 1.

As shown in FIG. 5, the contact 11 must be pivoted through a relatively small angle alpha in order to move its rear end portion between the illustrated position (of engagement with the stop 9) and the other position (shown in FIG. 5 by phantom lines) of engagement with the tip 8 of the terminal 7. The plane 25 (indicated in FIG. 5 by a phantom line) which halves the angle alpha is at least substantially parallel to the central longitudinal axis X of the externally threaded tube of the housing 1. The radius of curvature of the front end portion of the contact 11 (namely of that end portion which overlies the looped front end portion 10 of the terminal 6) is relatively large. This, combined with the rather small angle alpha, ensures that the contact 11 is subjected to relatively small flexural stresses and, therefore, can stand long periods of use. The front end portion of the contact 11 can be welded, soldered or otherwise electrically connected to the looped front end portion 10 of the terminal 6. Permanent bonding of the contact 11 to the terminal 6 is desirable and advantageous and is presently preferred over a hinge or a like connection because a hinge is subject to wear and generates at least some friction. Moreover, the absence of a hinge or an analogous pivotal connection ensures the absence of hysteresis with reference to a dead center position. The movability of the spring 11 is influenced exclusively by its internal friction.

Figure 3:
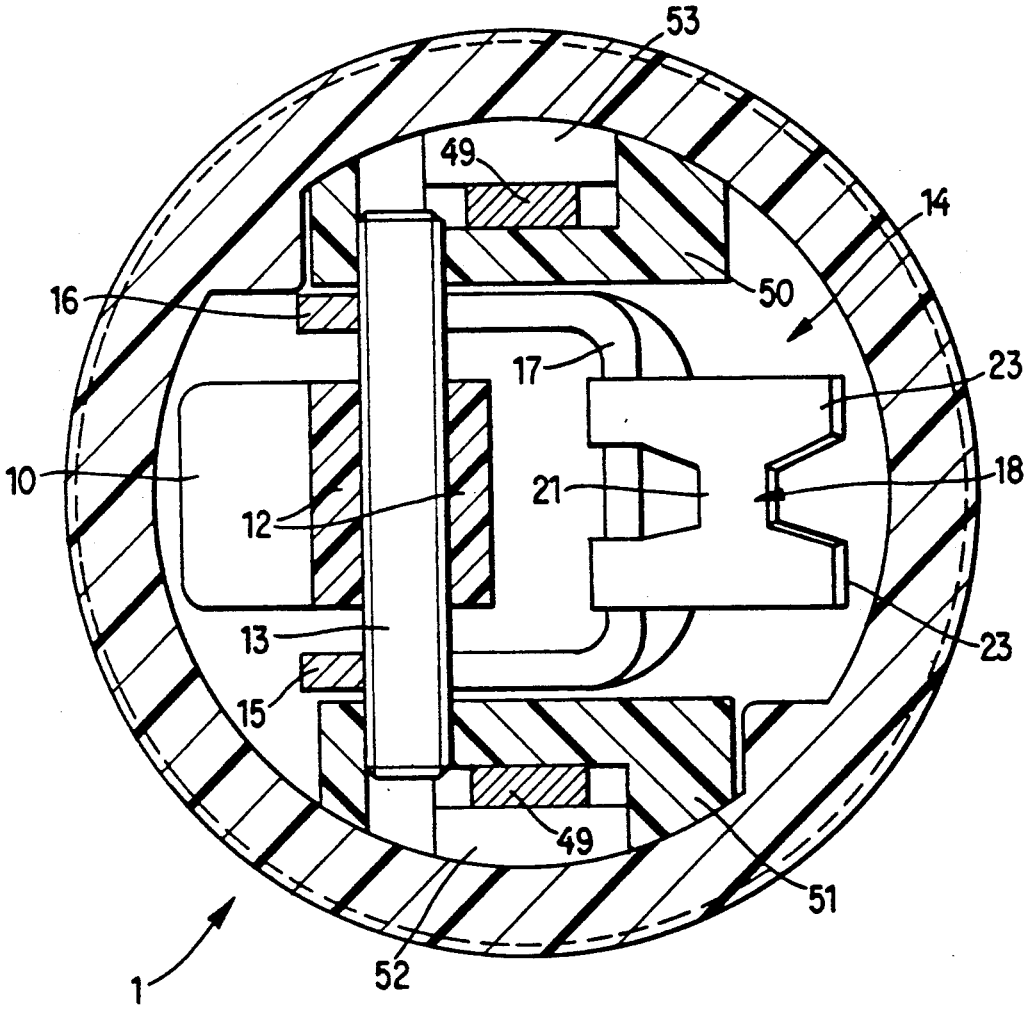
FIG. 3 is an enlarged sectional view as seen in the direction of arrows from the line III—III of FIG. 2.

The rear portion of a block-shaped bearing member 12 in the housing 1 carries a pivot member 13 for a retainer 14 in the form of a two-armed bell crank lever. The bearing member 12 is rigid with or is integrally connected to the base 5 and mounts the pivot member 13 at one side of, close to and at right angles to the axis X of the externally threaded tube of the housing 1. As shown in FIG. 3, the bearing member 12 is disposed between two cheeks 50, 51 which are rigid with the tube and/or with the base 5 of the housing 1 and flank the bell crank lever 14. The end portions of the pivot member 13 are rotatably or non-rotatably mounted in the respective cheeks 50, 51.

One arm of the lever 14 comprises two spaced-apart portions 15, 16 (see particularly FIG. 4) provided with triangular notches 19 which receive one end portion of a stressed snap action spring 20 the other end portion of which is bifurcated and normally bears against two shoulders 26 on an intermediate portion of the springy contact 11. The one arm of the lever 14 further comprises a bridge or web 17 which is integrally connected with the portions 15, 16. These portions resemble eyelets which surround the pivot member 13. The one end portion of the spring 20 is provided with a recess 20' which is flanked by two prongs extending into the notches 19 of the portions 15, 16 of the one arm of the lever 14. The depth of the recess 20' suffices to ensure that the one end portion of the spring 20 has requisite freedom of angular movement relative to the springy contact 11 in response to pivoting of the lever 14 about the axis of the pivot member 13.

The other arm of the lever 14 includes a tongue-like projection 18 which is integral with and extends from the bridge 17 substantially radially of the pivot member 13. The bridge 17 can be said to form part of the one arm (15, 16) or of the other arm (18) of the lever 14. The projection 18 resembles the letter H and includes a relatively narrow web 21 and two substantially parallel lugs or legs 23. The web 21 is parallel with and the lugs 23 are normal to the pivot member 13 for the lever 14. The web 21 is engaged by one end convolution of a helical restoring or return spring 22 which reacts against the bearing member 12 (FIGS. 1 and 2) and biases the lever 14 in a counterclockwise direction (as seen in FIGS. 1, 2 and 5). The lugs 23 constitute male detents forming part of a coupling which directly connects the lever 14 with a motion transmitting device 28 which, in turn, is rigid with the pushbutton 24 at the front end of the housing 1.

When the switch is fully assembled, the pushbutton 24 is movable by hand through a predetermined distance S (FIG. 1) from an extended position which is shown in FIG. 1 to a depressed position to thereby affect a movement of the springy contact 11 from the position of FIG. 1 (switch open) to the other position (which is shown in FIG. 5 by phantom lines and in which the switch is closed) through the medium of the motion transmitting device 28, the aforementioned coupling or connecting means including the lugs 23 of the lever 14, the one arm (15, 16) of the lever, and spring 20. Such movement of the contact 11 takes place against the resistance of the spring 22 which stores energy and returns the pushbutton 24 to the extended position of FIG. 1 when the pressure upon the pushbutton is reduced or terminated.

The distance between the portions 15, 16 of the one arm of the lever 14 suffices to ensure that these portions can bypass the looped portion 10 of the terminal 6 and the L-shaped portion of the contact 11 when the lever 14 is pivoted in a clockwise direction (as seen in FIG. 1) in response to movement of the pushbutton 24 to its depressed position. Such configuration of the one arm of the lever 14 ensures that this lever can perform a relatively large angular movement in a relatively small space. In addition, such configuration of the one arm (15, 16) of the lever 14 renders it possible to provide relatively short or relatively long portions 15, 16, i.e., to select the effective length of the one arm of the lever 14 from a rather wide range of lengths. Moreover, the aforediscussed configuration of the lever 14 renders it possible to place the pivot member 13 (and more particularly the axis of this pivot member) close or very close to the longitudinal axis X of the externally threaded tube of the housing 1. This, in turn, renders it possible to select the effective length of the second arm (including the projection 18) of the lever 14 from a wide range of lengths. The extent of pivotal movement of the lever 14 is determined by the extent (S) of movement of the pushbutton 24 (in a direction toward the base 5 at the rear end of the housing 1) which is required to move the contact 11 from the position of FIG. 1 to the other position in which the rear end portion of the contact engages the tip 8 of the terminal 7 to electrically connect the terminal 7 with the terminal 6.

The improved switch preferably utilizes a large-diameter and a relatively long pivot member 13 to thereby reduce the influence of wear upon the pivot member and lever 14 on the extent to which the pushbutton 24 must be depressed in order to change the position of the contact 11.

The magnitude of the angle alpha (FIG. 5) depends upon the length of the contact 11 and upon the distance between the stop 9 and the tip 8 of the terminal 7. The contact 11 is pivotable in the plane of FIG. 1 or FIG. 5, and the aforementioned plane 25 includes the axis of the pivot member 13. This renders it possible to move the notches 19 of portions 15, 16 of the one arm of the lever 14 along an arcuate path which includes the pivot axis of the contact 11, i.e., the distance of the pivot axis of the contact 11 from the axis of the pivot member 13 equals or approximates the distance of the notches 19 from the axis of the pivot member 13. This ensures that the dead-center position T of the snap action spring 20 during pivoting of the lever 14 in a clockwise direction (under the action of the pushbutton 24) coincides with the dead-center position of the spring 20 during pivoting of the lever 14 in a counter-clockwise direction (under the action of the spring 22 which reacts against the bearing member 12 and bears against the web 21 forming part of the other arm (projection 18) of the lever 14). The distance a (FIG. 5) between the plane 25 and a parallel plane including the axis X of the externally threaded tube of the housing 1 is relatively small for the afore-discussed reason, namely that the lever 14 can include a relatively long other arm (projection 18) even if the inner diameter of the externally threaded tube of the housing 1 is small.

The spring 20 is installed in stressed condition so that its bifurcated rear portion normally bears against the shoulders 26 at opposite sides of an intermediate portion of the springy contact 11 and urges the contact 11 against the stop 9 when the spring 22 is free to maintain the pushbutton 24 in the extended or inoperative position of FIG. 1. When the pushbutton 24 is depressed to pivot the lever 14 from the solid-line position to the phantom-line position of FIG. 5, the stressed spring 20 is caused to store additional energy under the action of the surfaces bounding the notches 19 in the one arm 15, 16 of the lever 14 until the spring 20 reaches the dead-center position T. When the spring 20 is moved beyond the dead-center position T in response to further pivoting of the lever 14 in a clockwise direction (as seen in FIG. 5), the spring 20 is free to dissipate energy and propels the rear end portion of the contact 11 against the tip 8 of the terminal 7. The arrangement is preferably such that the spring 20 continues to store some energy when the contact 11 already engages the tip 8 of the terminal 7, i.e., when the switch is closed. For example, the configuration and mounting of the lever 14, and the effective length of the contact 11 and the distance of the stop 9 from the tip 8 of the terminal 7, can be such that the lever 14 must be free to pivot through an angle of not more than 45 degrees, preferably approximately 35 degrees. However, it is equally possible to select an angle which is less than 35 degrees, depending upon the desired distance S of the depressed and extended positions of the pushbutton 24 from each other and also depending upon the desired effective length (R2 in FIG. 5) of the one arm 15, 16 and/or upon the desired effective length (R1 in FIG. 5) of the other arm (projection 18) of the lever 14. The extent of pivotability of the lever 14 about the axis of the pivot member 13 also depends upon the ratio of the effective lengths R2 and R1 of the two arms of the lever.

The spring 22 continuously tends to maintain the lever 14 in the solid-line position of FIG. 1 or 5, i.e., this spring tends to move the pushbutton 24 to and to maintain the pushbutton in the extended or inoperative position of FIG. 1. Thus, if the improved switch is a so-called momentary switch, the contact 11 is automatically disengaged from the tip 8 of the terminal 7 (i.e., the switch opens) as soon as the pressure upon the pushbutton 24 is relaxed or terminated so that the spring 22 can pull the lever 14 from the phantom-line position toward and all the way to the solid-line position of FIG. 5. This causes the spring 20 to move toward and beyond the dead-center position T of FIG. 5, i.e., the spring 20 is free to propel the rear end portion of the contact 11 away from the tip 8 of the terminal 7 and against the stop 9 to open the switch. The spring 22 is stronger than the spring 20 because it must be capable of overcoming the resistance of the spring 20 to movement toward the dead-center position T while the contact 11 engages the tip 8 of the terminal 7.

The extent of pivotal movement of the lever 14 from the phantom-line position to the solid-line position of FIG. 5 is limited by an edge 12' of the bearing member 12. The projection 18 of the lever 14 can abut the edge 12' of the bearing member 12 during installation of the spring 22, i.e., while one end convolution of the spring 22 is being attached to the bearing member 12 and/or while the other end convolution of the spring 22 is being attached to the web 21 of the projection 18 of the lever 14.

Figure 4:
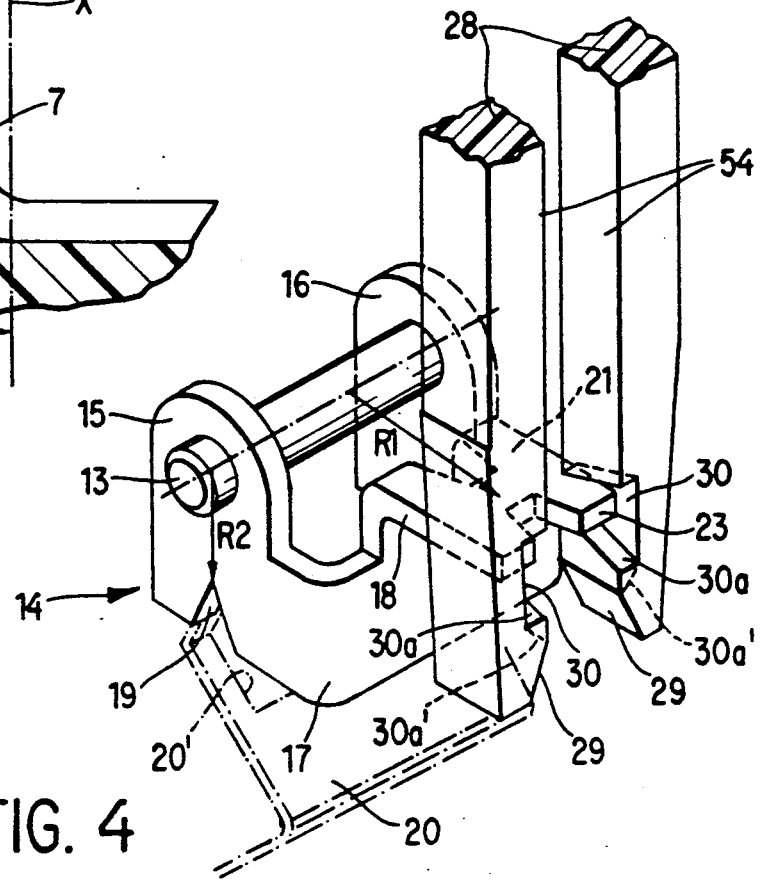
FIG. 4 is an enlarged perspective view of a detail in the switch of FIG. 1.

The illustrated lever 14 can be modified in the following way: Instead of extending downwardly (as seen in FIG. 4), the portions 15, 16 of the one arm of the lever 14 can extend upwardly beyond the pivot member 13. The illustrated (leaf) spring 20 is then replaced with a tensioned (stretched) coil spring (not shown) which is attached to the upwardly extending portions of the one arm of the lever and to an intermediate portion of the contact 11.

The motion transmitting device 28 between the pushbutton 24 and the projection 18 of the lever 14 is rigid or integral with a reflector 27 for a light source 46 (e.g., a light emitting diode) which is installed in the frame 2 of the housing 1 inwardly of the pushbutton 24 to illuminate the pushbutton 24 at least when the latter is maintained in depressed position. The device 28 comprises two resilient prongs (see particularly FIG. 4) which are parallel to the longitudinal axis X of externally threaded tube of the housing 1 and the rear end portions of which carry female detents 30 which receive the lugs 23 of the projection 18 of the lever 14, i.e., the prongs of the motion transmitting device 28 directly connect the lever 14 with the pushbutton 24 as well as with the reflector 27 for the light source 46. The reflector 27 is or can be integral with the front ends of the prongs which form part of or constitute the motion transmitting device 28.

It is necessary to spread the rear ends of the prongs of the device 28 in order to permit penetration of the lugs 23 into the respective female detents 30. To this end, the rear end portions of the prongs of the device 28 are provided with wedge-like cams 29 (FIG. 4) which slide along the outer sides of the respective lugs 23 during insertion of the prongs into the housing 1 whereby the resilient prongs store energy and cause their detents 30 to move toward each other as soon as the detents 30 are moved to positions of alignment with the respective lugs 23 on the projection 18 of the lever 14. The lugs 23 and the female detents 30 then cooperate to form a coupling or connecting means which establishes an articulate form-locking connection between the prongs of the motion transmitting device 28 and the lever 14. The female detents 30 are provided with wedge-shaped cutouts or notches the narrowest portions of which have a width which approximates the thickness of the respective lugs 23 on the projection 18 of the lever 14.

The just described coupling including the lugs 23 and the detents 30 compels the lever 14 to pivot in a clockwise direction (as viewed in FIG. 1) toward the phantom-line position of FIG. 5) in response to depression of the pushbutton 24 whereby the spring 20 moves toward and beyond the dead-center position T to propel the contact 11 against the tip 8 of the terminal 7 and to thus close the switch. As also explained above, the coil spring 22 continuously urges the lever 14 toward the solid-line position of FIG. 5 so that, when the pressure upon the pushbutton 24 is relaxed or terminated, the lever 14 pivots counter-clockwise (from the phantom-line position toward the solid-line position of FIG. 5) to move the spring 20 toward and beyond the dead-center position T whereby the spring 20 is free to snap over and to propel the contact 11 to the position of FIG. 1 in which the switch is open because the rear end portion of the contact 11 bears against the insulating stop 9.

The angle between the internal surfaces of female detents 30 (such surfaces flank the respective lugs 23 from above and from below, as seen in FIG. 4) preferably equals or approximates the maximum angle through which the lever 14 should be pivotable about the axis of the pivot member 13. In fact, these internal surfaces of the female detents 30 can constitute stops which determine the two end positions of the lever 14 relative to the bearing member 12.

The lower internal surfaces 30*a* of the female detents 30 can be replaced by rearwardly sloping surfaces 30*a*' (indicated in FIG. 4 by broken lines) if it is desired to repeatedly detach the pushbutton 24, the reflector 27 and the motion transmitting device 28 from the housing 1 and lever 14. Thus, if the surfaces 30*a* are replaced with the sloping surfaces 30*a*', a relatively strong pull upon the pushbutton 24 in a direction to move it upwardly and beyond the extended position of FIG. 1 will entail expulsion of the lugs 23 to permit complete extraction of the motion transmitting device 28 from the housing 1 by way of the open front end of the frame 2.

The feature that the reflector 27 is rigid or integral with the motion transmitting device 28 and pushbutton 24 renders it possible to rapidly assemble the switch by the simple expedient of inserting the prongs of the device 28 into the housing 1 by way of the open front end of the frame 2 and by forcing the cams 29 at the rear ends of the prongs against the male detents 23 until the cams bypass the lugs 23 and these lugs enter the respective female detents 30 in response to movement of the female detents 30 toward each other (because the prongs of the device 28 are then free to dissipate energy). FIG. 2 shows the assembly including the pushbutton 24, the reflector 27 and the prongs of the motion transmitting device 28 during insertion of the prongs into the housing 1 by way of the open front end of the frame 2. Once the lugs 23 have entered the respective female detents 30, the assembly including the parts 24, 27, 28 is non-separably (but articulately) coupled to the projection or arm 18 of the lever 14 and can be separated from the lever 14 only in response to a pronounced pull upon the pushbutton 24 in order to move it beyond the extended position of FIG. 1. Such pull is possible or is facilitated if the internal surfaces 30*a* of the female detents 30 are replaced with the rearwardly sloping surfaces 30*a*'.

If the improved mechanical switch constitutes a latching or alternate action switch, it further comprises an indexible blocking device 31 which is turnably mounted on the bearing member 12 and a specially designed indexing device 34 (see particularly FIGS. 6, 7 and 8) which cooperates with the blocking device 31 to prevent a return movement of the push-button 24 to the fully extended position of FIG. 1 (or to a partially extended position in which the switch is open) after a first depression of the pushbutton but to permit a return movement of the pushbutton to fully extended position in response to a renewed depression of the pushbutton, i.e., in response to renewed movement of the pushbutton to the fully depressed position.

The indexing device 34 includes a substantially plate- or strip-shaped member which is rigid with the pushbutton 24 (e.g., by being integral with the reflector 27) and extends rearwardly toward the base 5 of the housing 1. The blocking device 31 has a stub shaft 32 rotatably mounted in and at that side of the bearing member 12 which is remote from the coil spring 22. The exposed side of the blocking device 31 is provided with two round locating protuberances 33 which are disposed diametrically opposite each other with reference to the axis of the stub shaft 32 (see FIG. 8) and form part of means for properly locating or orienting the blocking device 31 in automatic response to initial insertion of the indexing device 34 into the housing 1. The protuberances 33 facilitate the assembly of the switch because they cooperate with complementary locating portions of the indexing device 34 to ensure proper orientation of the blocking device 31 relative to the bearing member 12 and indexing device 34 in response to insertion of the pushbutton 24 into the housing 1.

Figure 8:
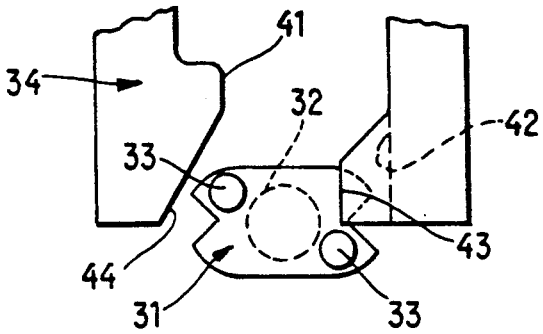
FIG. 8 shows a portion of the structure of FIG. 6 but with the blocking device in a different angular position.

FIGS. 1, 2 and 8 show that the diameter of the stub shaft 32 is relatively large; this is desirable and advantageous because the wear upon the stub shaft 32 and/or upon the adjacent portion of the bearing member 12 is less likely to result in wobbling of the blocking device 31. Such wobbling could prevent the devices 31, 34 from ensuring that the switch can be operated as a latching or alternate action switch.

Figure 6:
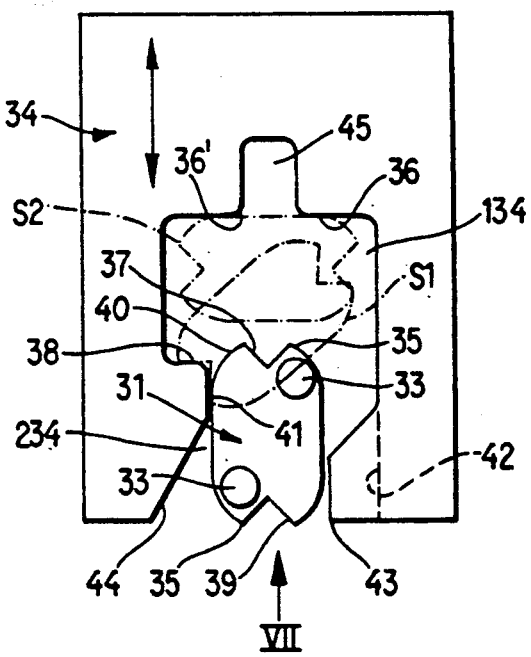
FIG. 6 is an enlarged view of the indexing and blocking devices as seen in the direction of arrows VI in FIGS. 1 and 2.

The indexing device 34 has a chamber 134 with an inlet 234 which enables the blocking device 31 to enter the chamber 134 in response to insertion of the pushbutton 24 into the housing 1. The properly oriented elongated blocking device 31 extends in substantial parallelism with the axis X of the externally threaded tube of the housing 1 (see FIG. 6). If the pushbutton 24 is depressed, the indexing device 34 moves beyond the position of FIG. 1, namely downwardly as seen in FIG. 6. This moves a convex internal surface 36 of the device 34 against the aligned edge 35 of the blocking device 31 so that the latter is indexed clockwise (as seen in FIG. 6). The surface 36 is located in the chamber 134 of the indexing device 34. In addition to being indexed by the convex surface 36, the blocking device 31 is also indexed by a second convex internal surface 36' in the chamber 34; to this end, the surface 36' engages a convex external surface 40 of the blocking device 31 so that the latter is indexed clockwise (as seen in FIG. 6) in response to depression of the pushbutton 24. Indexing of the blocking device 31 in a clockwise direction is terminated when the surface 36 enters a notch 37 of the blocking device to thus prevent further depression of the pushbutton 24. The spring 20 has moved beyond the dead-center position T of FIG. 5 (to propel the contact 11 against the tip 8 of the terminal 7 and to thus close the switch) before the moving indexing device 34 has caused the blocking device 31 to assume a position in which the surface 36 extends into the notch 37. When the pressure upon the pushbutton 24 is relaxed, the spring 22 urges the indexing device 34 (through the medium of the lever 14, prongs of the motion transmitting device 28 and reflector 27) toward the solid-line position of FIG. 6; however, the return movement of the pushbutton 24 to the fully extended position is prevented by a convex surface 38 which forms part of the indexing device 34 and is located in the chamber 134 because this convex surface enters the notch 39 of the indexible blocking device 31. The latter then assumes the position S1 of FIG. 6. The surface bounding the notch 39 intercepts the convex surface 38 (and hence the pushbutton 24) before the spring 20 is free to propel the contact 11 against the stop 9, i.e., the switch remains closed.

If the pushbutton 24 is thereupon depressed for a second time, the indexing device 34 is moved downwardly (as seen in FIG. 6) and indexes the blocking device 31 clockwise from the position S1 to the position S2. This prevents further depression of the pushbutton 24. The spring 22 is then free to dissipate energy and moves the indexing device 34 upward, as seen in FIG. 6, to the end position of FIG. 1. As the indexing device 34 moves back toward the position of FIG. 1 (under the action of the spring 22), the convex surface 38 of the device 34 indexes the blocking device 31 in a clockwise direction until a flat portion of the peripheral surface of the device 31 comes into abutment with the surface or facet 41 which flanks a portion of the inlet 234 of the indexing device 34. The surface 41 then maintains the blocking device 31 in the angular position which is shown in FIG. 6 by solid lines until the pushbutton 24 is depressed again to move the indexing device 34 away from the position of FIG. 1 or 6.

Figure 7:
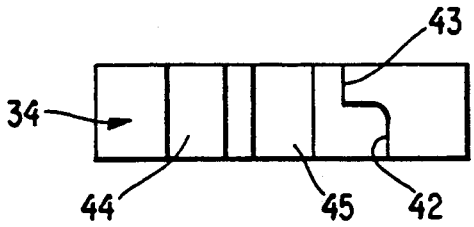
FIG. 7 is a view of the indexing device as seen in the direction of arrow VII in FIG. 6.

FIGS. 6 to 8 show that the indexing device 34 is formed with a cutout 42 which is adjacent and communicates with the inlet 234 and extends in the direction of movement of the indexing device with the pushbutton 24. The purpose of the surface bounding the cutout 42 is to cooperate with one of the locating protuberances 33 on the blocking device 31 in order to ensure proper orientation of the blocking device on entry into the inlet 234. When the assembly including the pushbutton 24, the reflector 27, the motion transmitting device 28 and the indexing device 34 is inserted into the housing 1 in a manner as shown in FIG. 2, the angular position of the blocking device 31 can deviate from the desired angular position. For example, if the blocking device 31 extends transversely of the direction of movement of the indexing device 34 into the housing 1 (such position of the blocking device is shown in FIG. 8), a locating edge 43 adjacent the cutout 42 and inlet 234 strikes against one of the protuberances 33 and indexes the blocking device in a clockwise direction toward an angular position (shown in FIG. 6) in which the blocking device extends longitudinally of the housing 1 and is properly oriented for entry into the inlet 234. As the indexing device 34 continues to move deeper into the housing 1, the convex portion 40 of the peripheral surface of the blocking device 31 is engaged by a sloping cam face 44 of the indexing device 34 (the cam face 44 flanks the inlet 234 opposite the notch 42) whereby the cam face 44 continues to turn the blocking device in a clockwise direction until a straight portion of the peripheral surface of the device 31 reaches and abuts the facet or surface 41. This completes the locating or orientation changing operation, i.e., the blocking device 31 is then in an optimum position to cooperate with the indexing device 34 and to enable the switch to operate as an alternate action or latching switch.

The just described locating means 33, 43 on the devices 31 and 34 ensure that the initial angular position of the blocking device 31 during insertion of the indexing device 34 into the housing 1 is immaterial, i.e., the locating means automatically change the orientation of the blocking device until the blocking device is ready to cooperate with the indexing device 34 in the aforedescribed manner, namely so that the first, third, fifth, etc. depressions of the pushbutton 24 result in retention of the contact 11 in engagement with the tip 8 of the terminal 7, and that the second, fourth, sixth, etc. depressions of the pushbutton must precede a complete return movement of the pushbutton to the extended position of FIG. 1 under the action of the coil spring 22.

The chamber 134 of the indexing device 34 communicates with a recess 45 which is located diametrically opposite the space between the prongs of the motion transmitting device 28 and serves to receive a portion of a holder 47 forming part of or supporting the light source 46. The latter has two contacts 48 which extend beyond the holder 47 and engage complementary electric contacts 49 in sockets 52, 53 (FIG. 3) within the housing 1. The contacts 48 are parallel to the axis X of the externally threaded tube of the housing 1. The end portions of the holder 47 constitute followers one of which extends into the recess 45 of the indexing device 34 and the other of which extends into the space between the prongs of the motion transmitting device 28. The surfaces bounding the recess 45 of the blocking device 34 and the surfaces 54 of the prongs forming part of the motion transmitting device 28 constitute a guide means for the end portions or followers of the holder 47. The length of the guide means at least equals the distance S between the depressed and extended positions of the pushbutton 24. The extent of movability of the devices 34, 28 relative to the inserted light source 46 is limited by stops 55, one in the deepmost portion of the recess 45 of the indexing device 34 and the other in the deepmost portion of the slot between the surfaces 54 of the prongs forming part of the device 28, and by entraining projections 56 extending from the surfaces 54 of the prongs. The entraining projections 56 confront each other.

The pushbutton 24, the reflector 27 and the devices 28, 34 can be said to constitute a tool which facilitates insertion of the light source 46 into the housing 1. Thus, the holder 47 of the light source 46 is assembled with the tool including the pushbutton 24 prior to introduction of the devices 28, 34 into the housing 1 by way of the open end of the frame 2. This results in introduction of contacts 48 into the sockets 52, 53, i.e., in engagement of the contacts 48 with the complementary contacts 49. The contacts 49 extend rearwardly beyond the base 5 of the housing 1 (see FIGS. 1 and 2). When the female detents 30 on the prongs of the motion transmitting device 28 are properly coupled to the corresponding lugs 23 on the projection or arm 18 of the lever 14, the light source 46 is properly inserted into the housing 1 and the switch is ready for use. The pushbutton 24 is then reciprocable relative to the inserted light source 46 because the distance S is not greater than the length of the guide means including the surfaces 54 of prongs forming part of the motion transmitting device 28.

If the light source 46 is to be inspected or replaced, the pushbutton 24 and the reflector 27 are moved beyond the extended positions of FIG. 1. This causes the projections 56 on the prongs of the device 28 to entrain the end portions or followers of the holder 47 upwardly, as seen in FIG. 1, so that the holder 47 and the light source 46 are extracted from the housing 1 jointly with the aforementioned tool including the parts 24, 27, 28 and 34. When the light source 46 is properly inserted into the housing 1, it is completely surrounded by the substantially cylindrical reflector 27. This holds true when the pushbutton 24 is held in the extended position of FIG. 1 or in the depressed position in which the pushbutton can be held by the devices 31, 34 until it is depressed again to initiate an indexing of the blocking device 31 in the afore-described manner.

The light source 46 constitutes an optional feature of the improved switch. The end portions of the holder 47 for the light source 46 can be retained in the housing 1 by frictionally engaging the internal surface of the externally threaded tube of the housing in fully inserted position of the holder.

The bearing member 12 is or can be integral with the base 5. The lever 14 and the springs 20, 22 can be assembled on the base 5 (which carries the terminals 6, 7), and the thus assembled parts can be tested before the base 5 is rigidly connected with the externally threaded tube of the housing 1. The last step of assembling the switch includes insertion of the tool 24, 27, 28, 34 and (if desired) of the light source 46 into the housing 1 by way of the open front end of the frame 2.

An advantage of the feature that the bearing member 12 is integral with or is rigidly connectable to the base 5 is that several parts of the switch can be assembled on the bearing member before the latter is inserted into the externally threaded tube of the housing 1, i.e., before the base 5 is affixed to the major portion of the housing. This simplifies the mounting of the lever 14 and of the springs 20, 22 with attendant savings in time and renders it possible to test the operation of the thus assembled parts prior to insertion of the bearing member 12 into the major portion of the housing 1. Moreover, the lever 14 and the springs 20, 22 are readily accessible for replacement or adjustment prior to insertion of the bearing member 12 into the tube of the housing 1. Such mode of assembling the lever 14 and the springs 20, 22 with the housing portions 5, 12 renders it possible to automate the assembly of the parts 14, 20, 22 with the housing portions 5, 12 to a desired extent.

An advantage of the structure which is shown in FIG. 5 is that the dead-center position T of the stressed spring 20 is the same regardless of whether the lever 14 is pivoted in a clockwise direction or in a counterclockwise direction. This is due to the fact that the distance of the pivot axis of the contact 11 relative to the looped front end portion 10 of the terminal 6 from the axis of the pivot member 13 equals or at least approximates distance of the arcuate path of movement of the notches 19 for the front end portion of the spring 20 from the axis of the pivot member 13. Moreover, such construction and mounting of the lever 14, contact 11 and spring 20 render it possible to shorten the arcuate path of movement of the notches 19 (i.e., of the front end portion of the spring 20) with attendant reduction of the diameter of externally threaded tube of the housing 1. In addition, the just discussed design renders it possible to reduce the overall length of the switch. Still further, it is possible to use a sturdy large-diameter pivot member 13 which is subject to minimal wear and does not appreciably change its diameter as a result of wear so that the useful life of the switch is prolonged and the operation of the switch is not affected by wear for long periods of time. As a rule, the lever 14 can be pivoted without any stray movements during the entire useful life of the switch.

The feature that the return spring 22 reacts against the bearing member 12 and urges the lever 14 to one of its end positions, namely to that end position which corresponds to the extended position of the pushbutton 24, contributes to convenience of assembly and manipulation of the switch. Thus, such feature contributes to more uniform force-distance ratio during depression of the pushbutton 24 (i.e., the magnitude of the force which is required to depress the pushbutton 24 remains at least substantially unchanged during each stage of depression) which is desirable to the person in charge of manipulating the switch. The just discussed feature is further attributable to the fact that the housing 1 is elongated, that the plane 25 which halves the angle alpha is at least substantially parallel to the axis X of the externally threaded tube of the housing 1, and that the plane which halves the angle through which the lever 14 can be pivoted between its end positions is normal or substantially normal to the axis X.

The feature that the motion transmitting device 28 is reciprocable longitudinally of the housing 1 whereas the notches 19 for the front end portion of the spring 20 move substantially transversely of the housing 1 renders it possible to select a relatively long distance S for movement of the pushbutton 24 between its extended and depressed positions and a relatively short distance for movement of the notches 19 during pivoting of the lever 14 between its end positions. This, in turn, renders it possible to reduce the diameter of the externally threaded tube of the housing 1.

The feature that the motion transmitting device 28 is directly connected to the projection or arm 18 of the lever 14 is desirable and advantageous because this ensures that each and every stage of movement of the pushbutton 24 from extended to depressed position entails a movement of the notches 19 transversely of the axis X and that such conversion of a movement of the pushbutton 24 longitudinally of the housing 1 into a movement of the notches 19 transversely of the housing can be performed without any (or without any appreciable) play between the motion transmitting device 28 and the lever 14. Moreover, direct coupling of the motion transmitting device 28 (i.e., of the pushbutton 24) to the lever 14 ensures that the condition of the switch can be changed (from open to closed or from closed to open) in a highly predictable manner. Still further, a single spring (22) suffices to return the contact 11, the lever 14 and the spring 20 to the positions of FIG. 1 as well as to return the pushbutton 24 to the extended position. In addition, the feature that a single spring (22) can perform all of the afore-enumerated functions renders it possible to reduce the number of parts and to thus enhance the simplicity of the switch. The fact that the prongs of the motion transmitting device 28 are at least slightly resilient is of no consequence because, when these prongs properly engage the lugs 23 of the lever 14, the device 28 acts as a rigid body which can convert each stage of movement of the pushbutton 24 from extended position into a pivotal movement of the lever 14.

Though it is possible to employ a separately produced reflector 27 which is then secured to the motion transmitting device 28, the utilization of a one-piece structure wherein the prongs of the device 28 are integral with the reflector 27 contributes to simplicity and lower initial cost of the switch and to a simplification of mounting of the reflector in the housing 1. Thus, a single step must be carried out in order to properly mount the reflector 27 and the motion transmitting device 28 (together with the pushbutton 24 and indexing device 34) in the housing 1. Such insertion results in automatic coupling of female detents 30 to the adjacent lugs 23. The utilization of resilient prongs as component parts of the motion transmitting device 28 also contributes to simplicity and convenience of assembling the device 28 and pushbutton 24 with the lever 14.

The devices 31, 34 constitute an optional feature of the improved switch. If they are used, the illustrated and described indexible blocking device 31 (with a large-diameter and preferably long stub shaft 32 which is mounted in the bearing member 12) reduces the likelihood of malfunctioning of the alternate action switch because the wear upon the stub shaft 32 and/or upon the adjacent portion of the bearing member 12 does not affect the accuracy of indexing of the blocking device 31 for long periods of use, normally during the entire useful life of the alternate action switch. Since the orientation of the blocking device 31 is automatically changed (when necessary) in response to insertion of the indexing device 34 into the housing 1, the person or a robot in charge of assembling the switch need not be concerned with the initial angular position of the blocking device, i.e., the aforediscussed locating means including the protuberances 33 of the device 33 and the locating edge 43 of the indexing device 34 take care of properly orienting the device 31 (if necessary) so that the latter is ready to cooperate with the device 34 and to enable the switch to be used as an alternate action switch as soon as the motion transmitting device 28 is properly connected to the lever 14. Since the pivot member 13 is mounted in the bearing member 12, the same as the stub shaft 32 of the blocking device 31, the device 31 is in an optimum position relative to the pivot axis for the lever 14; this contributes to reliability of operation of the switch as an alternate action switch.

A further important advantage of the improved switch is that the removal or extraction of the light source 46 from the housing 1 involves a simple operation, namely a single step of pulling the pushbutton 24 outwardly and beyond the extended position of FIG. 1. The entraining projections 56 on the prongs of the motion transmitting device 28 then extract the holder 47 for the light source 46 from the externally threaded tube of the housing 1 so that the light source can be inspected or replaced prior to reinsertion of the tool including the push-button 24, the reflector 27, the prongs of the motion transmitting device 28 and the indexing device 34 into the housing 1.

It is possible to design the holder 47 for the light source 46 and the guide means (including the surface bounding the recess 45 of the indexing device 34 and the surfaces 54 on the prongs of the motion transmitting device 28) in such a way that the light source can be installed between the devices 28, 34 in a single orientation. This is desirable because one of the contacts 49 can be designated as the plus pole and the other contact 49 can be designated as the minus pole for attachment to a d-c energy source for the light source 46. This simplifies the attachment of such energy source to the contacts 49.

The mechanical switch of the present invention constitutes an improvement over and a further development of the switch which is disclosed in commonly owned U.S. Pat. No. 4,398,075 granted Aug. 9, 1983 to Vogel. A different mechanical switch is disclosed in commonly owned copending patent application Ser. No. 07/301,611 filed Jan. 24, 1989 by Berger, now U.S. Pat. No. 4,945,194 granted Jul. 31, 1990. Electric switches with depressible pushbuttons and with reflectors for light sources are disclosed in commonly owned copending patent applications Ser. Nos. 07/530,653 and 07/530,654 both filed May 30, 1990 by Torma et al.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A mechanical switch comprising a housing; a bearing member in said housing; a contact disposed in said housing and movable between first and second positions; and means for moving said contact between said positions, including a retainer, means for movably mounting said retainer on said bearing member, a stressed spring having a first portion reacting against said retainer and a second portion bearing against said contact, and actuator means for moving said retainer relative to said bearing member to thereby move said contact by way of said spring, said retainer including a lever and said mounting means defining for said lever a pivot axis, said lever including a first arm having a portion which is engaged by the first portion of said spring and is located at a predetermined distance from said pivot axis, said contact being pivotable relative to said housing about a second axis which is located at or close to said predetermined distance from said pivot axis and said lever further including a second arm, said actuator means comprising a depressible pushbutton, a reflector rigid with said pushbutton and means for transmitting motion from said reflector to the second arm of said lever, said motion transmitting means comprising two resilient prongs and said actuator means further comprising means for articulately connecting said prongs to said second arm, said connecting means comprising complementary first and second detents provided on said prongs and on said second arm, respectively.

2. The switch of claim 1, wherein said contact is resilient and is pivotable between said positions in a predetermined plane and through a predetermined angle having two halves at opposite sides of a second plane, said retainer being movable relative to said bearing member substantially transversely of said second plane and said bearing member being affixed to said housing.

3. The switch of claim 1, wherein said spring biases said lever in a first direction and further comprising a second spring which operates between said bearing member and said lever to bias the lever in a second direction counter to said first direction.

4. The switch of claim 3, wherein said lever is pivotable between two end positions and said second spring is operative to bias said lever to one of said end positions, said actuator means being operable to move the lever to the other of said end positions against the resistance of said second spring.

5. The switch of claim 3, wherein said lever is a bell crank lever having a second arm which is engaged by said second spring.

6. The switch of claim 3, wherein said second arm of said lever is engaged by said second spring and said housing includes an elongated tube, said second arm being pivotable through an angle having two halves at opposite sides of a plane which is substantially normal to the axis of said tube.

7. The switch of claim 1, wherein said housing includes a tube and said pushbutton is movable in the axial direction of said tube, a translatory movement of said pushbutton being converted into pivotal movement of said lever and vice versa.

8. The switch of claim 7, wherein said motion transmitting means is rigid with said pushbutton and said connecting means includes means for directly coupling said motion transmitting means to said second arm.

9. The switch of claim 1, further comprising an indexible blocking device provided on said bearing member, said actuator means further comprising an indexing device for said blocking device and said indexing device being reciprocable between first and second positions, said devices having cooperating locking portions which prevent a return movement of said indexing device to said second position in response to a first movement of the indexing device to said first position but permit a return movement of the indexing device to said second position in response to a second movement of the indexing device to said first position.

10. The switch of claim 9, wherein said pushbutton is depressible to affect a movement of said indexing device from the second to the first position and said switch further comprising means for yieldably biasing said indexing device to said second position thereof.

11. The switch of claim 9, wherein said indexing device comprises a chamber for said blocking device and an inlet for admission of said blocking device into said chamber in response to movement of said indexing device from said second position to said first position thereof, said devices comprising means for locating said blocking device in a predetermined angular position in response to movement of said indexing device to the first position thereof and the locating means of said indexing device being adjacent said inlet.

12. The switch of claim 1, further comprising a light source provided in said housing and having first electric contacts, complementary second electric contacts provided in said housing and means for engaging and disengaging said first contacts from said second contacts, said engaging and disengaging means including said reflector for said light source.

13. The switch of claim 12, wherein said housing has sockets for said first contacts.

14. The switch of claim 12, wherein said pushbutton overlies said light source.

* * * * *